US007161499B2

(12) United States Patent
Vaysse et al.

(10) Patent No.: US 7,161,499 B2
(45) Date of Patent: Jan. 9, 2007

(54) SYSTEM FOR MONITORING A PLURALITY OF ZONES

(75) Inventors: Bertrand Vaysse, Toulouse (FR); Pierre Lascours, Cugnaux (FR); Céline Virgulin, Cugnaux (FR); Laurent Escaich, Toulouse (FR); Jean-Yves Vilain, Pibrac (FR)

(73) Assignee: Airbus France, Toulouse (FR)

( * ) Notice: Subject to any disclaimer, the term of this patent is extended or adjusted under 35 U.S.C. 154(b) by 61 days.

(21) Appl. No.: 10/976,805

(22) Filed: Nov. 1, 2004

(65) Prior Publication Data

US 2005/0168335 A1 Aug. 4, 2005

(30) Foreign Application Priority Data

Nov. 3, 2003 (FR) ..... 03 12853

(51) Int. Cl.
*G08B 21/00* (2006.01)

(52) U.S. Cl. ..... 340/945; 340/524; 340/3.1; 340/825.36; 340/825.49

(58) Field of Classification Search ..... 340/945, 340/506, 524, 508, 3.1, 825.36, 825.49
See application file for complete search history.

(56) References Cited

U.S. PATENT DOCUMENTS 4,195,286 A 3/1980 Galvin
4,279,395 A 7/1981 Boggio et al.
4,305,556 A 12/1981 Norton et al.
4,641,243 A 2/1987 Hartkopf et al.
6,972,676 B1 * 12/2005 Kimmel et al. ..... 340/506
7,012,534 B1 * 3/2006 Chaco ..... 340/573.1
7,019,642 B1 * 3/2006 Nelson et al. ..... 340/539.1
7,019,644 B1 * 3/2006 Barrie ..... 340/539.13
7,026,937 B1 * 4/2006 Przygoda, Jr. ..... 340/572.4

FOREIGN PATENT DOCUMENTS

FR 2524674 10/1983

* cited by examiner

*Primary Examiner*—Daryl C Pope
(74) *Attorney, Agent, or Firm*—Stevens, Davis, Miller & Mosher, LLP

(57) ABSTRACT

A system for monitoring a plurality of zones includes detection devices, disposed in the zones to be monitored, that emit detection signals on two different channels. A processor processes the signals and includes first and second computers, respectively connected to one or the other of the channels, and electrically isolating links that connect the first and second computers.

6 Claims, 3 Drawing Sheets

SYSTEM FOR MONITORING A PLURALITY OF ZONES

FIELD OF THE INVENTION

The present invention relates to a system for monitoring a plurality of zones. Although not exclusively, such a system is most particularly appropriate to be implemented for the centralized detection of fire in a plurality of zones, in particular on board an aircraft, so that, hereinafter, the invention will be more specially described in relation to such an application.

BACKGROUND OF THE RELATED ART

It is known that it is particularly important for the crew of an aircraft to be warned as early as possible of a fire breaking out on board, in particular in unpressurized zones of the aircraft that are some distance apart, such as the engines carried by the wings, the main landing gear bay disposed in the intermediate part of the fuselage or the bay of the auxiliary power unit provided in the rear part of said fuselage.

For this purpose, aircraft are equipped with a centralized system for monitoring said zones comprising electrical detection devices respectively disposed in said zones, as well as means for processing the detection signals emitted by said detection devices and alarm means actuated by said processing means, said processing and alarm means being disposed in the vicinity or in the cockpit, that is to say at a location some distance from said detection devices.

The detection devices comprise fire detectors of known types, for example pneumatic or thermoresistive (more particularly with a negative temperature coefficient), disposed in pairs for detection redundancy purposes. Moreover, to limit the number of links between the detection devices and the processing means (and hence to save weight in terms of conductors) and also to limit the number of said processing means, each detection device comprises only two output channels and, in each pair of detectors, one of said detectors is connected to one of said channels while the other detector is connected to the other channel. Thus, said output channels are independent of one another and in the case of a plurality n of pairs of detectors in a detection device (n being an integer different from zero), there are n detectors arranged in parallel and connected to an output channel and n detectors, also arranged in parallel, but connected to the other output channel.

Moreover, said processing means consist of a set of individual computers, each of which is associated with a monitored zone and receives the information conveyed by the two independent channels of the detection device disposed in said zone. Thus, said computer associated with a zone can permanently compare the information that it receives from said two independent channels, and in particular when one of the channels conveys information regarding fire in the zone considered, said associated computer can verify this information by comparing it with that transmitted by the other channel and determine whether it does or does not have to transmit an alarm signal to said alarm means.

It will be noted that such a manner of operation requires each computer of the processing means to comprise two independent elementary computers (boards) electrically isolated from one another, thereby complicating the structure thereof and increasing the cost thereof.

Moreover, these known monitoring systems are disadvantageous as regards weight and costs, since they require a computer (double) per monitored zone. Thus, if the number of monitored zones is equal to six, twelve elementary computers have to be provided.

SUMMARY OF THE INVENTION

An object of the present invention is to remedy these drawbacks and it relates to a monitoring system architecture making it possible to significantly reduce the number of said elementary computers, while ensuring the same security of detection.

For this purpose, according to the invention, the system for monitoring a plurality of zones, comprising:

- detection devices, each of which is disposed in one of said zones to be monitored and comprises a first and a second output channel, each detection device comprising at least one pair of associated detectors for detection redundancy purposes, a detector of each pair being connected to the first corresponding output channel while the other detector of said pair is connected to the second output channel of said detection device;
- means of processing the detection signals emitted by said detection devices; and
- alarm means actuated by said means for processing the detection signals, is noteworthy in that:

- said means of processing the detection signals comprise:
- first computers each of which is connected to first channels of detection devices, in such a way that each first channel is connected once only to a first computer, and
- second computers each of which is connected to second channels of detection devices, in such a way that each second channel is connected once only to a second computer; and
- electrically isolating links are provided between said first and second computers, in such a way that a first computer and a second computer that are connected to one and the same detection device can communicate with one another.

Thus, by virtue of the fact that each first and second computer can be connected to several detection devices and that links exist between said first and second computers, the number of computers of the means for processing the detection signals can be reduced. Furthermore, since each first and second computer is connected to only one output channel of a detection device and is isolated from the other output channel of the latter by said electrically isolated links, its structure may be single and not double with internal electrical isolation, as in the prior art. Thus, if the number of zones to be monitored is equal to six as in the example above, the number of elementary computers of the means for processing the detection signals can be cut to four, instead of the twelve required previously.

Said electrically isolating links may be RF, magnetic or other links. However, preferably, they are optical and may be embodied by optical fibers and optoelectronic components. They may be discrete or digital.

Preferably, for safety purposes and to allow communications between each first (or second) computer and at least two second (or first) computers, no first (or second) computer is connected exactly to the same set of detection devices as a second (or first) computer.

In the particular case where the number of zones to be monitored is equal to six, the monitoring system in accordance with the present invention can comprise:

two first computers, each connected to three detection devices; and two second computers, each of which is also connected to three detection devices.

Thus, each first (or second) computer can communicate, by way of said electrically isolating links, with each of the two second (or first) computers.

If, furthermore, the system in accordance with the present invention is intended for detecting fire in unpressurized zones of a four-engine aircraft, it is advantageous that none of said first and second computers is connected to more than two detection devices each associated with an engine. Thus, a simple operating fault of the system cannot affect more than one engine.

BRIEF DESCRIPTION OF THE DRAWINGS

The figures of the appended drawing will elucidate the manner in which the invention may be embodied. In these figures, identical references designate similar elements.

DETAILED DESCRIPTION OF THE INVENTION

Figure 1:
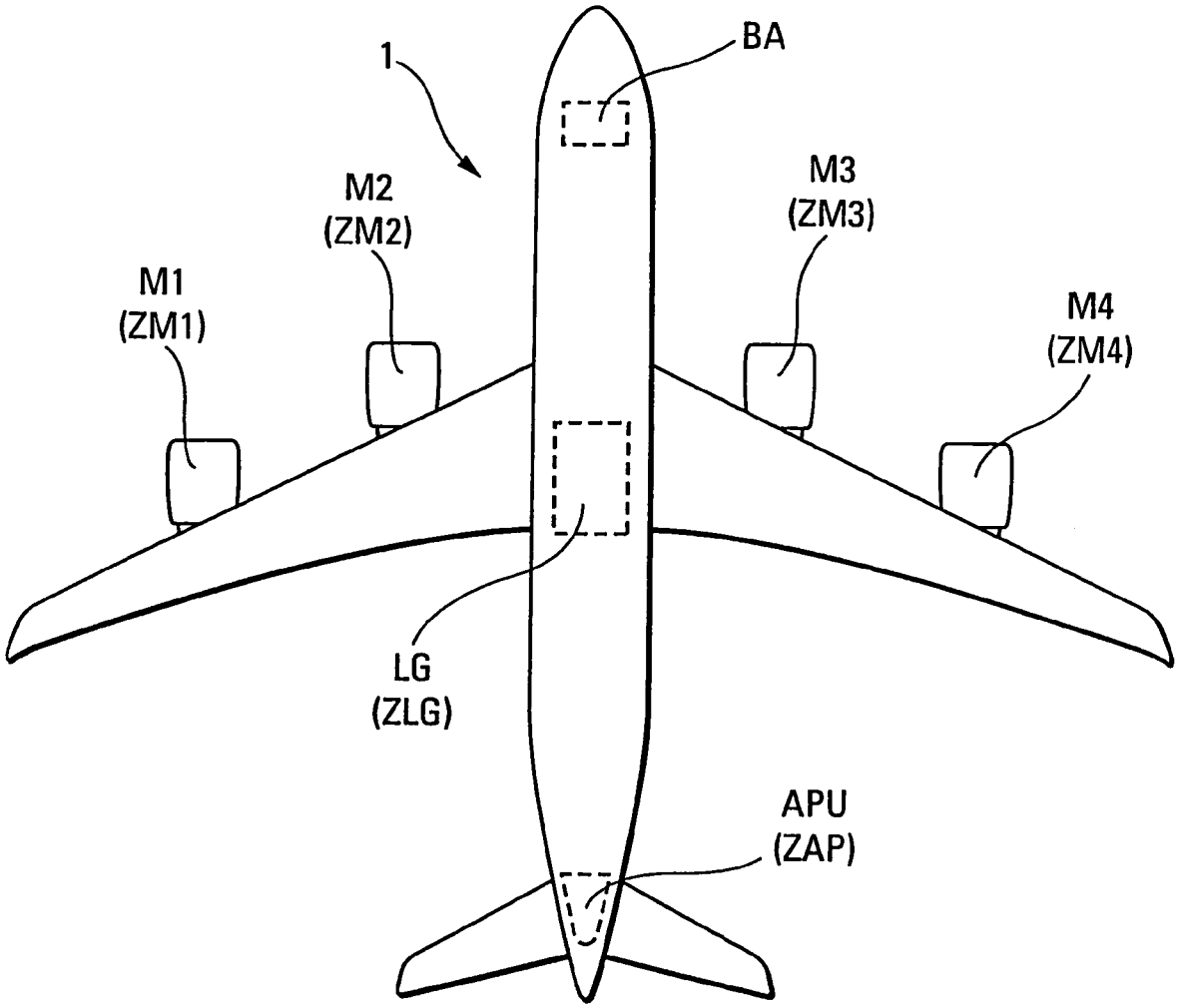
FIG. 1 illustrates an application of the monitoring system according to the invention to the detection of fire in unpressurized zones of an airplane.

The four-engine airplane 1, represented diagrammatically in FIG. 1, comprises six unpressurized zones in which it is important to be able to detect a fire. These are:

four zones ZM1, ZM2, ZM3 and ZM4 corresponding respectively to the four engines M1, M2, M3 and M4;

the zone ZAP corresponding to the location of the auxiliary power source APU; and the zone ZLG corresponding to the bay of the main landing gear LG.

In each of these six zones ZM1, ZM2, ZM3, ZM4, ZAP and ZLG is disposed a corresponding fire detection device DZM1, DZM2, DZM3, DZM4, DZAP and DZLG respectively.

Each fire detection device DZM1 to DZM4, DZAP and DZLG comprises a first and a second output channel respectively bearing the references ZM1A and ZM1B; ZM2A and ZM2B; ZM3A and ZM3B; ZM4A and ZM4B; ZAPA and ZAPB; and ZLGA and ZLGB.

Furthermore, each of said fire detection devices consists of pairs of fire detectors, each comprising a detector dA and a detector dB together monitoring the same location of the corresponding zone, for detection redundancy purposes.

In each of the six detection devices DZM1 to DZM4, DZAP and DZLG:

all the detectors dA are connected in parallel with the corresponding first channel ZM1A to ZM4A, ZAPA or ZLGA; and all the detectors dB are connected in parallel with the corresponding second channel ZM1B to ZM4B; ZAPB or ZLGB.

Figure 2:
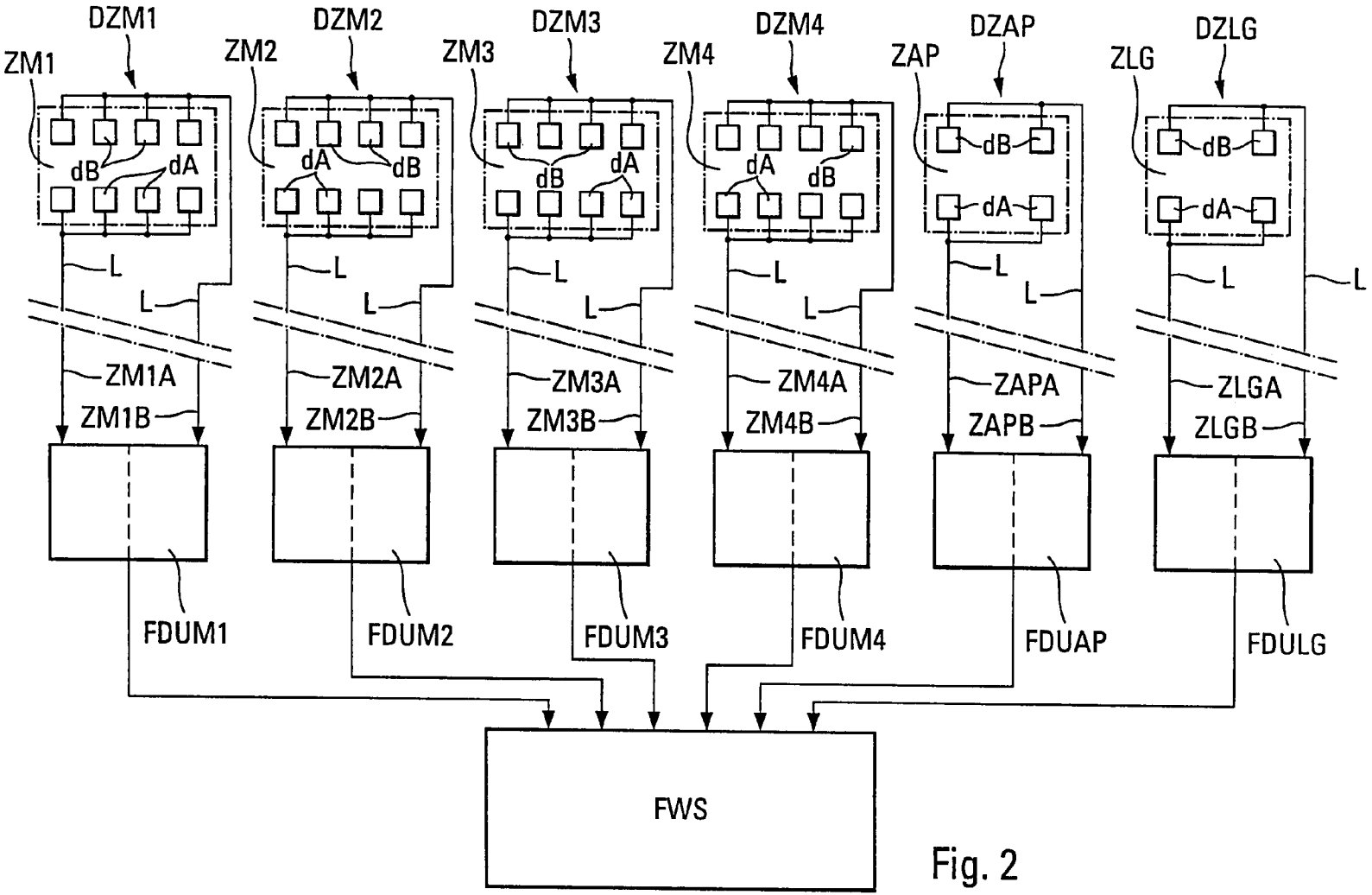
FIG. 2 shows the schematic diagram of a known fire detection system for the airplane of FIG. 1.

Furthermore, with each zone ZM1 to ZM4, ZAP and ZLG is associated a computer FDUM1 to FDUM4, FDUAP and FDULG, respectively, connected to the first and to the second channel of the corresponding detection device DZM1 to DZM4, DZAP and DZLG. Thus, each of these individual computers receives the state of each of the detectors dA and dB of the associated detection device and determines, by comparing said states, whether or not a fire exists in the corresponding zone. It will be noted that, in order to independently process the information that they receive from said first and second channels, said computers FDUM1 to FDUM4, FDUAP and FDULG must exhibit two electrically isolated parts, as is suggested in FIG. 2 by the dashed dividing lines.

After processing the information received on their two channels, said computers FDUM1 to FDUM4, FDUAP and FDULG transmit the result of their monitoring to an alarm system FWS.

It will be observed that, while the detectors DZM1 to DZM4, DZAP and DZLG are disposed in the zones that they monitor, the computers FDUM1 to FDUM4, FDUA and FDLG and the alarm system FWS are situated in the avionics rack BA, in the vicinity or in the cockpit (see FIG. 1). There therefore exist very long lines L (not represented in FIG. 1 for the sake of clarity) traversing the airplane 1 between said detectors and said computers.

In the system in accordance with the present invention and represented in FIG. 3, all the elements described hereinabove with regard to the known system of FIG. 2 are found again, with the exception of the fact that the individual computers FDUM1 to FDUM4, FDUAP and FDULG are replaced with a computation unit FDU.

Inside a box 2, the computation unit FDU comprises four computers C1A, C2B, C3A and C4B, taking for example the form of electronic boards.

Figure 3:
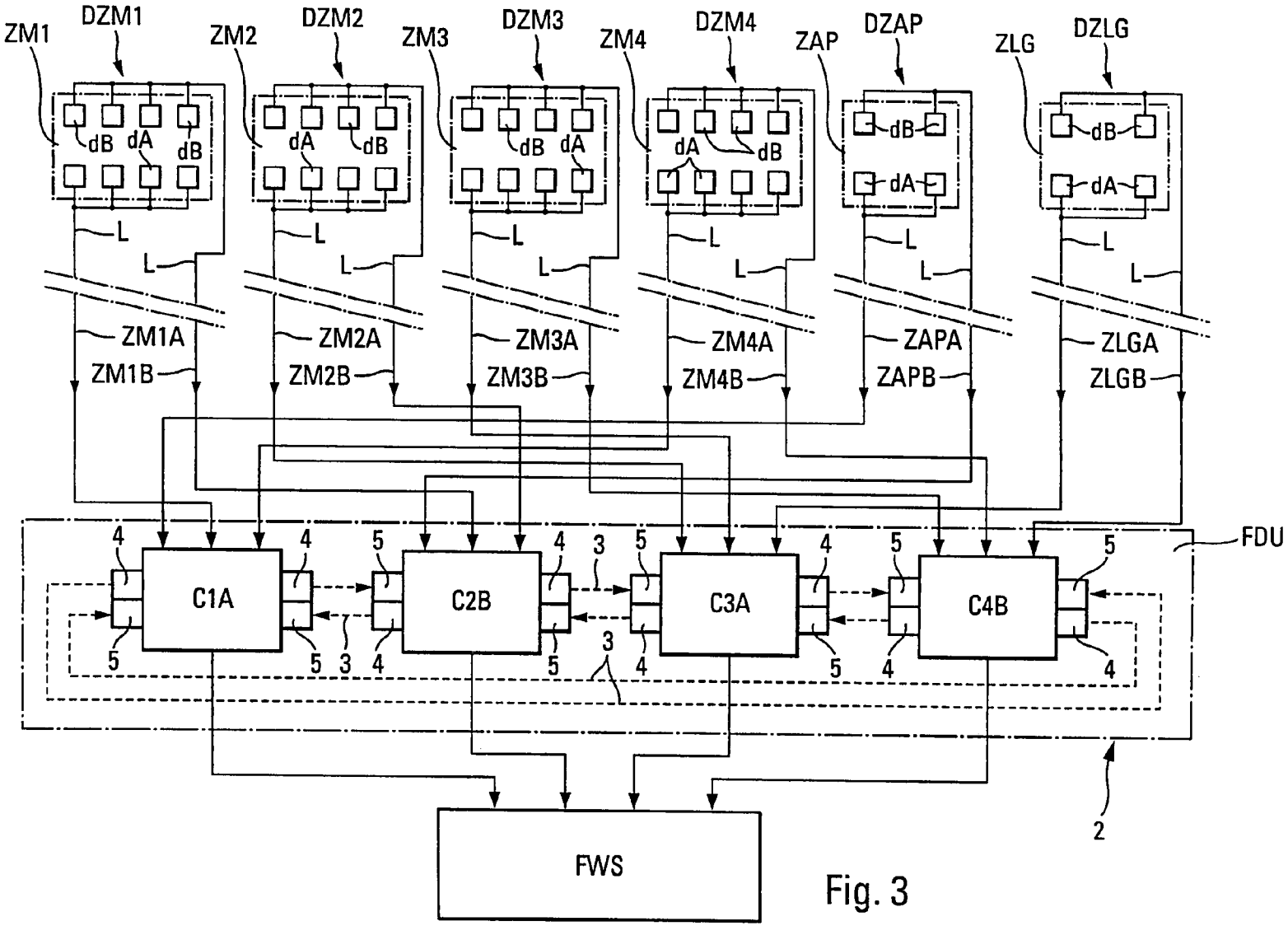
FIG. 3 shows the schematic diagram of the fire detection system in accordance with the present invention for the airplane of FIG. 1.

As may be seen in FIG. 3:

the computer C1A is connected to the first channels ZM1A, ZM4A and ZAPA of the detectors DZM1, DZM4 and DZAP, respectively;

the computer C2B is connected to the second channels ZM1B, ZM2B and ZAPB of the detectors DZM1, DZM2 and DZAP, respectively;

the computer C3A is connected to the first channels ZM2A, ZM3A and ZLGA of the detectors DZM2, DZM3 and DZLG, respectively; and the computer C4B is connected to the second channels ZM3B, ZM4B and ZLGB of the detectors DZM3, DZM4 and DZLG, respectively.

Moreover, via electrically isolated optical links 3:

the computer C1A can communicate with the computers C2B and C4B;

the computer C2B can communicate with the computers C1A and C3A;

the computer C3A can communicate with the computers C2B and C4B; and the computer C4B can communicate with the computers C1A and C3A.

The optical links 3 may be embodied by optoelectronic links or by optical fibers, associated with optoelectronic emitters and receivers 4, 5, linked with the computers C1A, C2B, C3A and C4B.

It will be readily understood that thus, by virtue of the optical links 3, each of the computers C1A, C2B, C3A and C4B directly receiving an item of information from one of the channels of one of the detectors DZM1 to DZM4, DZAP, DZLG can compare this item of information with that conveyed by the other channel of said detector and received by another computer, so as to determine whether or not there is cause to address an alarm signal to the alarm system FWS and/or to any other local alarm device (not represented), for example that disposed in the ceiling of the cockpit.

The invention claimed is:

1. A system for monitoring a plurality of zones (ZM1 to ZM4, ZAP, ZLG), the system comprising:

detection devices (DZM1 to DZM4, DZAP, DZLG), each of which is disposed in one of said zones to be monitored and comprises a first (ZM1A to ZM4A, ZAPA, ZLGA) and a second (ZM1B to ZM4B, ZAPB, ZLGB) output channel, each detection device comprising at least one pair of associated detectors (dA, dB) for detection redundancy purposes, a detector (dA) of each pair being connected to the first corresponding output channel while the other detector (dB) of said pair is connected to the second output channel of said detection device;

means (FDU) of processing the detection signals emitted by said detection devices; and an alarm means (FWS) actuated by said means for processing the detection signals, wherein:

said means of processing the detection signals (FDU) comprise:

first computers (C1A, C3A) each of which is connected to first channels of detection devices, in such a way that each first channel is connected once only to a first computer, and second computers (C2B, C4B) each of which is connected to second channels of detection devices, in such a way that each second channel is connected once only to a second computer; and electrically isolating links (3) are provided between said first (C1A, C2A) and second (C2B, C4B) computers, in such a way that a first computer and a second computer that are connected to one and the same detection device can communicate with one another.

2. The system as claimed in claim 1, wherein said electrically isolating links (3) are optical.

3. The system as claimed in claim 1, wherein no first (or second) computer is connected exactly to the same set of detection devices as a second (or first) computer.

4. The system as claimed in claim 1, for the monitoring of six zones, which system comprises:

two first computers (C1A, C3A), each connected to three detection devices; and two second computers (C2B, C4B), each of which is also connected to three detection devices.

5. The system as claimed in claim 3, wherein each first (or second) computer communicates, by way of said electrically isolating links (3), with each of the two second (or first) computers.

6. The system as claimed in claim 1, intended for detecting fire in unpressurized zones of a four-engine aircraft (1), wherein none of said first and second computers is connected to more than two detection devices (DZM1 to DZM4) each associated with an engine.

* * * * *